US007413501B2

(12) United States Patent
Priewasser

(10) Patent No.: US 7,413,501 B2
(45) Date of Patent: Aug. 19, 2008

(54) METHOD FOR CONCAVE GRINDING OF WAFER AND UNEVENNESS-ABSORBING PAD

(75) Inventor: Karl Heinz Priewasser, Munich (DE)

(73) Assignee: Disco Corporation, Tokyo (JP)

( * ) Notice: Subject to any disclaimer, the term of this patent is extended or adjusted under 35 U.S.C. 154(b) by 0 days.

(21) Appl. No.: 11/716,601

(22) Filed: Mar. 12, 2007

(65) Prior Publication Data

US 2007/0212986 A1 Sep. 13, 2007

(30) Foreign Application Priority Data

Mar. 13, 2006 (JP) ..... 2006-067387

(51) Int. Cl.
*B24B 1/00* (2006.01)

(52) U.S. Cl. ..... 451/41; 451/58

(58) Field of Classification Search ..... 451/41, 451/285–289, 58, 921, 490, 526–539
See application file for complete search history.

(56) References Cited

U.S. PATENT DOCUMENTS 5,871,393 A * 2/1999 Shiozawa ..... 451/285
6,527,627 B2 * 3/2003 Arai ..... 451/41
6,702,652 B2 * 3/2004 Arai ..... 451/41
6,780,091 B2 * 8/2004 Mizomoto et al. ..... 451/67
6,837,776 B2 * 1/2005 Shimobeppu et al. ..... 451/41
2006/0244096 A1 * 11/2006 Sekiya ..... 257/510

FOREIGN PATENT DOCUMENTS

JP 2004-319885 11/2004

* cited by examiner

*Primary Examiner*—Dung Van Nguyen
(74) *Attorney, Agent, or Firm*—Wenderoth, Lind & Ponack, L.L.P.

(57) ABSTRACT

To facilitate handling of a wafer with its thickness reduced by grinding its rear surface, and prevent any protrusions and depressions matching those of the front surface from being formed on its rear surface, the method including the steps of disposing an unevenness absorbing pad between a chuck table and a device region of the wafer for absorbing unevenness of the device region, and causing the wafer held by the chuck table to be rotated and ground, while having a grindstone kept in contact with rear surface of the wafer at center of rotation of the wafer, and out of contact with a portion of its rear surface opposite from the outer excess region, thereby forming a concavity in the portion of the rear surface of the wafer opposite from the device region, and forming an annular reinforcing portion including the outer excess region around the concavity.

9 Claims, 5 Drawing Sheets

METHOD FOR CONCAVE GRINDING OF WAFER AND UNEVENNESS-ABSORBING PAD

BACKGROUND OF THE INVENTION

1. Field of the Invention

The present invention relates to a method of grinding the rear surface of a wafer to form a concavity therein and an unevenness absorbing pad for supporting a wafer during its grinding.

2. Related Art

A wafer having a plurality of IC, LSI or like devices formed on its front surface is cut into the individual devices by means of e.g. a dicing apparatus and those devices are widely used in various kinds of electronic machines and instruments. Before a wafer is cut into the individual devices, it is ground on its whole rear surface, while its front surface is held by a chuck table in a grinding machine, so that its thickness may be reduced to, say, 20 to 100 μm to enable a reduction in size and weight of electronic machines and instruments, as described in, for example, JP-A-2004-319885.

However, a wafer ground and reduced in thickness loses rigidity and its handling and transportation are thereafter difficult. For example, its handling is not easy when it has to be removed from the chuck table in the grinding machine, or when it has to be cut into the individual devices, and it is also difficult to transport from one process step to another. Its handling is also difficult when its ground rear surface has to be coated with a gold, silver, titanium or other metal film having a thickness of several tens of nanometers, and its electrical testing is also difficult.

Moreover, a wafer having a very small thickness not exceeding 50 μm gives devices having uneven rear surface with a low degree of flatness having protrusions and depressions matching those of the front surface, and those devices have undesirably low die strength.

SUMMARY OF THE INVENTION

It is, therefore, an object of the present invention to facilitate the handling of a wafer with its thickness reduced by the grinding of its rear surface, and prevent any protrusions and depressions matching those of the front surface from being formed on its rear surface.

According to a first aspect of the present invention, there is provided a method for grinding a wafer to form a concave on a rear surface thereof, the wafer having on its front surface a device region defining a plurality of devices therein and an outer excess region surrounding the device region, by employing a grinding apparatus including a chuck table for holding the wafer rotatably and a grinder having a rotatable grindstone, the method comprising the steps of: disposing an unevenness absorbing pad between the chuck table and the device region of the wafer for absorbing unevenness of the device region; and causing the wafer held by the chuck table to be rotated and ground, while having the grindstone kept in contact with the rear surface of the wafer at center of rotation of the wafer, and out of contact with a portion of its rear surface opposite from the outer excess region, thereby forming a concavity in the portion of the rear surface of the wafer opposite from the device region, and forming an annular reinforcing portion including the outer excess region around the concavity.

The unevenness-absorbing pad preferably has a porous resin sheet. The porous resin sheet may, for example, be a porous sheet of polyethylene. Also, the unevenness-absorbing pad may include a non-porous sheet laminated on the porous resin sheet.

The unevenness-absorbing pad preferably has an adhesive layer formed on one surface thereof to allow the wafer to adhere to the pad. The adhesive layer is preferably formed only in the portion of the unevenness-absorbing pad corresponding to the outer excess region of the wafer.

The unevenness-absorbing pad may be placed on the chuck table, while the wafer is placed on the pad and held thereon by suction.

According to a second aspect of the invention, there is provided an unevenness-absorbing pad comprises a porous resin sheet having an adhesive layer formed on one surface thereof for bonding it to a wafer.

The unevenness-absorbing pad may, for example, be formed from a porous resin sheet and a non-porous sheet laminated thereon. The adhesive layer is preferably formed only in a portion of the pad corresponding to an outer excess region of the wafer. The porous resin sheet may, for example, be a porous sheet of polyethylene.

According to the present invention, the grinding of the rear surface of a wafer is carried out in such a manner that concavity is formed only in its rear surface portion corresponding to the device region on its front surface and the concavity is surrounded by an annular reinforcing portion which reinforces the wafer having thickness reduced in the device region of the front surface. Accordingly, the wafer in which the concavity is formed is easy to remove from the chuck table in the grinding apparatus and is also easy to handle in any process step thereafter or transport from one process step to another. The unevenness absorbing pad disposed between the device region of the wafer and the chuck table absorbs the unevenness of the wafer on its front surface and thereby prevents any corresponding unevenness from being formed on its rear surface, so that the wafer may not cause undesirably low die strength in a device.

The adhesive layer formed only on the portion of the unevenness absorbing pad corresponding to the outer excess portion of the wafer ensures that the removal of the unevenness absorbing pad from the ground wafer will not leave any adhesive in its device region, and therefore the quality of any device may not lower.

The porous resin sheet of the unevenness-absorbing pad can hold a wafer without relying on any adhesive, since its pores can transmit suction force from the chuck table to the wafer surface.

DETAILED DESCRIPTION OF THE PREFERRED EMBODIMENTS

Figure 1:
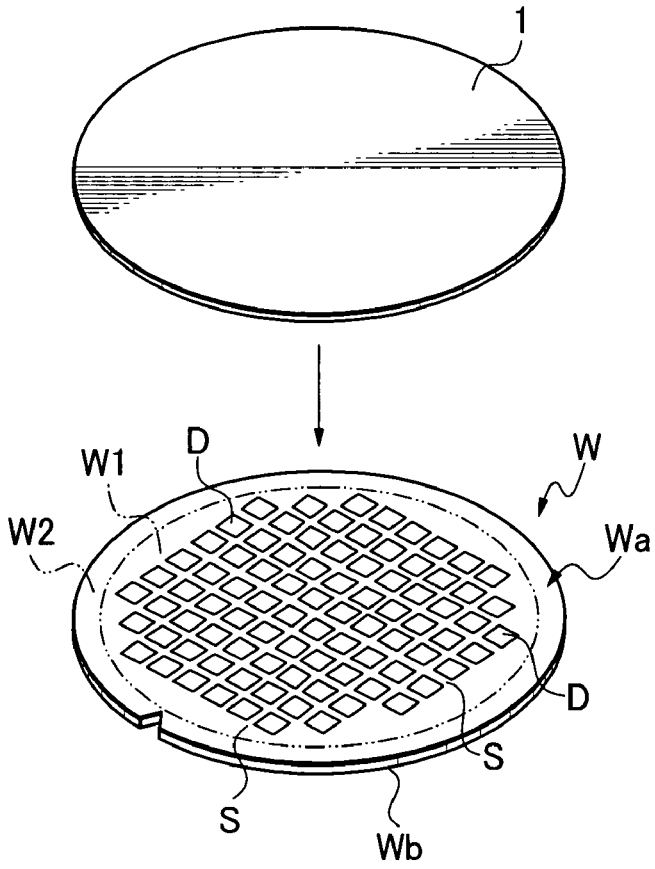
FIG. 1 is a perspective view of a wafer and an unevenness-absorbing pad.

A wafer W has a front surface Wa on which a device region W1 defining a plurality of devices D and an outer excess region W2 surrounding the device region W1 are formed, as shown in FIG. 1. The devices D in the device region W1 are divided from one another by vertical and horizontal streets S.

Figure 2:
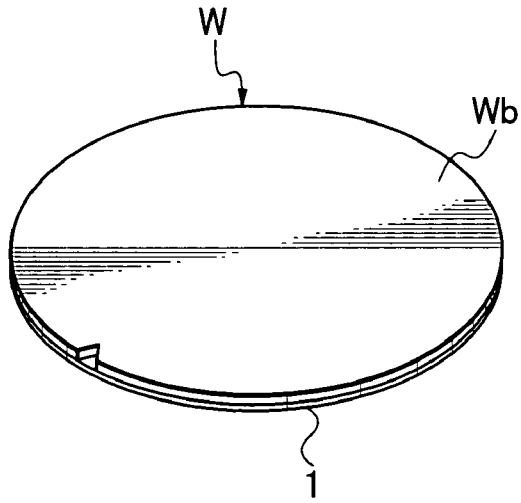
FIG. 2 is a perspective view of the unevenness-absorbing pad bonded to the surface of the wafer.

An unevenness-absorbing pad 1 is bonded to the front surface Wa of the wafer W and the bonded assembly is inverted, as shown in FIG. 2. The unevenness-absorbing pad 1 is formed from a soft and flexible material that can absorb unevenness formed in the device region W1 of the wafer W while its rear surface Wb is ground. For example, it may be formed from a porous resin sheet having a multiplicity of fine pores extending therethrough between its front and rear surfaces.

Figure 3:
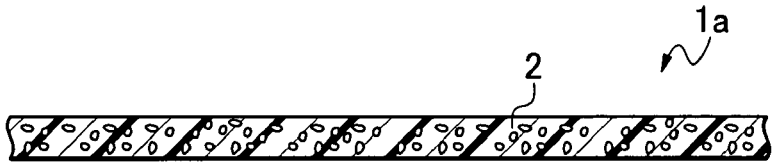
FIG. 3 is a cross sectional view of a first example of unevenness absorbing pad.
Figure 4:
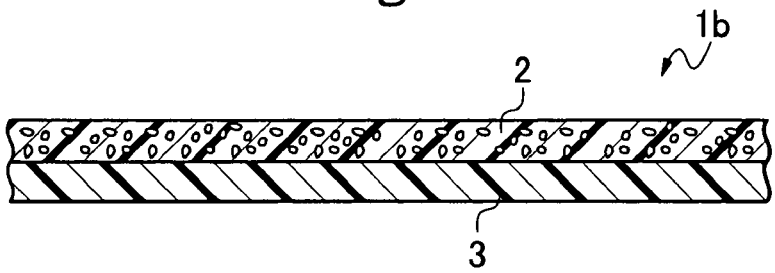
FIG. 4 is a cross sectional view of a second example of unevenness absorbing pad.

The unevenness-absorbing pad may be formed solely from a porous resin sheet 2 as shown at 1*a* in FIG. 3, or from a laminated assembly of a porous resin sheet 2 and a non-porous sheet 3 as shown at 1*b* in FIG. 4. The porous resin sheet 2 may, for example, be a porous sheet of polyethylene. A more specific example is a porous sheet of ultrahigh molecular polyethylene supplied by NITTO DENKO CORP under the name of "SUNMAP" (of LC or HP Series). The non-porous sheet may be a sheet of a soft and flexible material, such as vinyl chloride.

Figure 5:
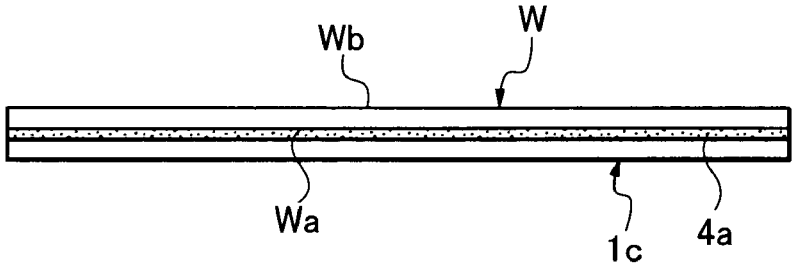
FIG. 5 is a cross sectional view including a schematic illustration of a first example of adhesive layer.
Figure 6:
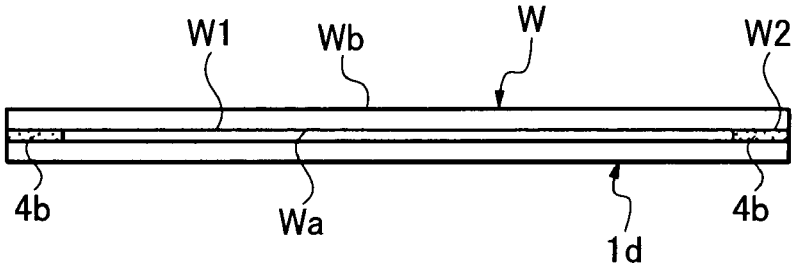
FIG. 6 is a cross sectional view including a schematic illustration of a second example of adhesive layer.

The unevenness-absorbing pad 1 has an adhesive layer formed on one side thereof for bonding it to the wafer W. The adhesive layer 4*a* may be formed on the whole surface of the unevenness absorbing pad 1*c* as shown in FIG. 5, or only on the portion of the unevenness absorbing pad 1*d* corresponding to the outer excess region W2 of the wafer W (its portion to be bonded to the outer excess portion W2) as shown in FIG. 6.

Figure 7:
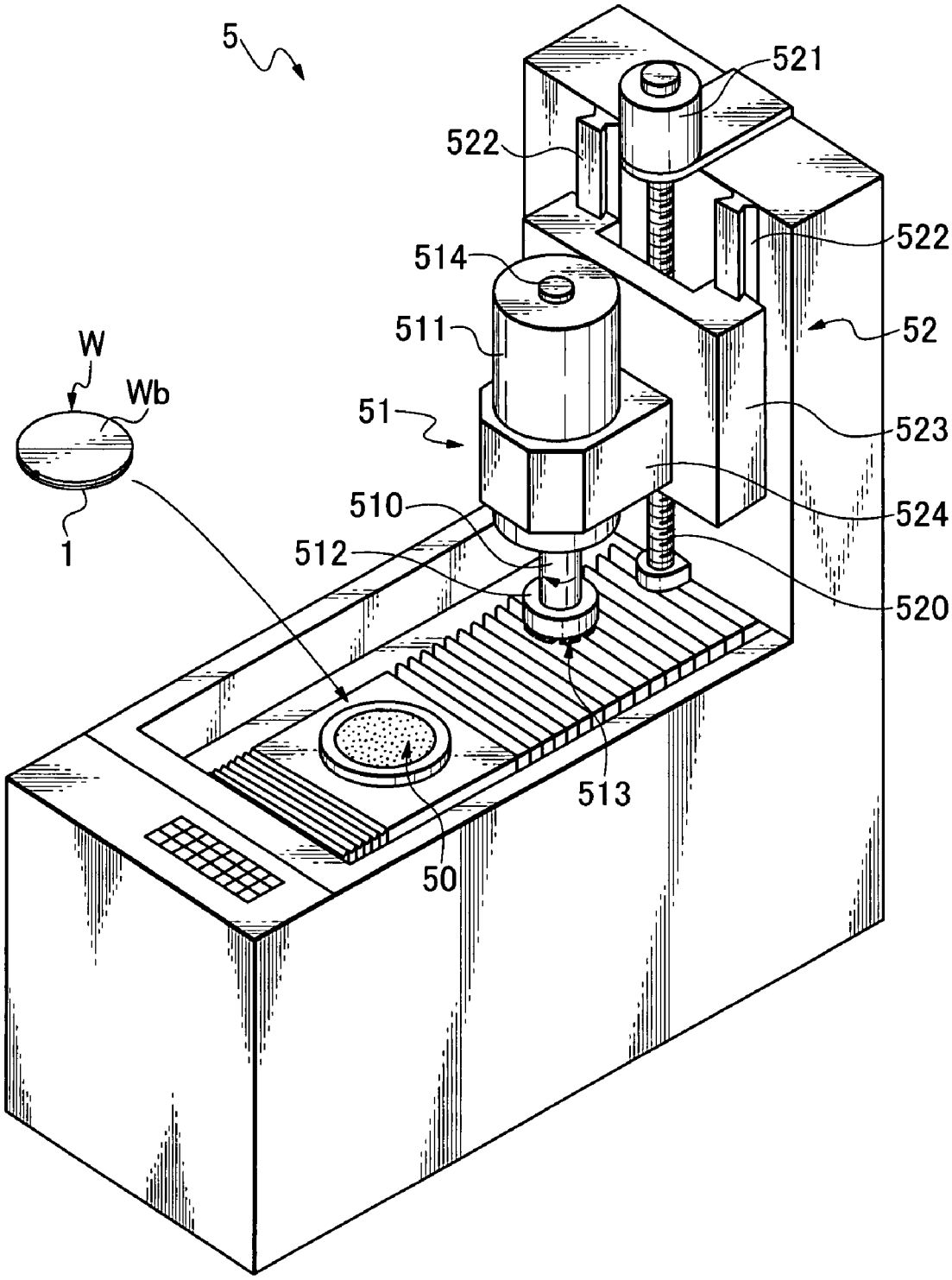
FIG. 7 is a perspective view of a grinding apparatus.

A grinding apparatus 5 as shown in FIG. 7 is, for example, employed for grinding the rear surface Wb of the wafer W. The grinding apparatus 5 includes a chuck table 50 for holding a wafer under suction rotatably, a grinder 51 for grinding the wafer held by the chuck table 50 and a grinder feeder 52 for moving the grinder 51.

The chuck table 50 is movable horizontally, as well as rotatably, and descends immediately under the grinder 51 when the wafer W is ground. The grinder 51 includes a rotary shaft 510 rotatable about a vertical axis of rotation, a housing 511 supporting the rotary shaft 510 rotatably, a wheel 512 formed at the lower end of the rotary shaft 510, a grindstone 513 composed of a plurality of grindstone segments fixed to the lower surface of the wheel 512 and a motor 514 for rotating the rotary shaft 510. With the rotation of the rotary shaft 510 driven by the motor 514, the wheel 512 and the grindstone 513 are also rotated. The grindstone segments composing the grindstone 513 are fixed in a circular array so as to draw an arcuate path of rotation.

The grinder feeder 52 includes a vertically extending ball screw 520, a pulse motor 521 for rotating the ball screw 520, a pair of guide rails 522 extending in parallel to the ball screw 520, an elevator 523 containing a nut, not shown, which threadedly engages the ball screw 520 and having two side portions making respective sliding contact with the guide rails 522, and a support 524 connected to the elevator 523 and supporting the housing 511.

Figure 8:
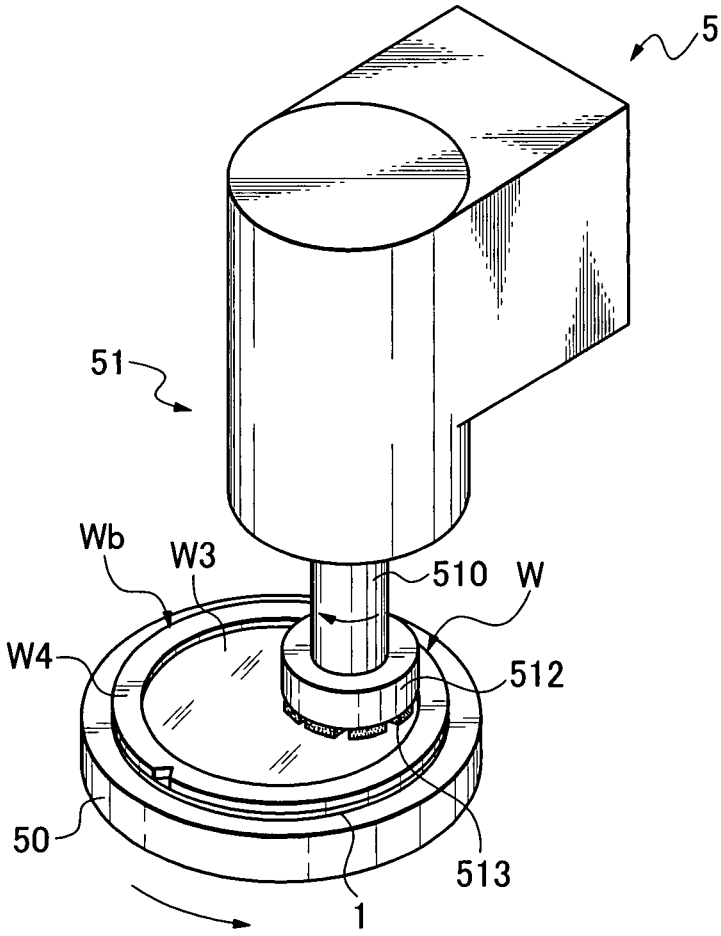
FIG. 8 is a perspective view of a wafer having its rear surface being ground.

The wafer W is held by the chuck table 50 on its side of the unevenness-absorbing pad 1, has its rear surface Wb exposed, and is positioned immediately under the grinder 51. The chuck table 50 is rotated to rotate the wafer W and while the rotary shaft 510 is rotated, the grinder 51 descends and the rotating grindstone 513 is brought into contact with the rear surface Wb of the wafer W and pressed against it to grind it, as shown in FIG. 8.

At that time, the grindstone 513 is brought into contact with the rear surface of the wafer W only at the portion opposite from its device region W1 and not on the portion opposite from its outer excess region W2. As a result, a concavity W3 is formed in the portion of the rear surface of the wafer W opposite from its device region W1, and an annular reinforcing portion W4 including the outer excess region W2 is formed surrounding the device region W1.

Figure 9:
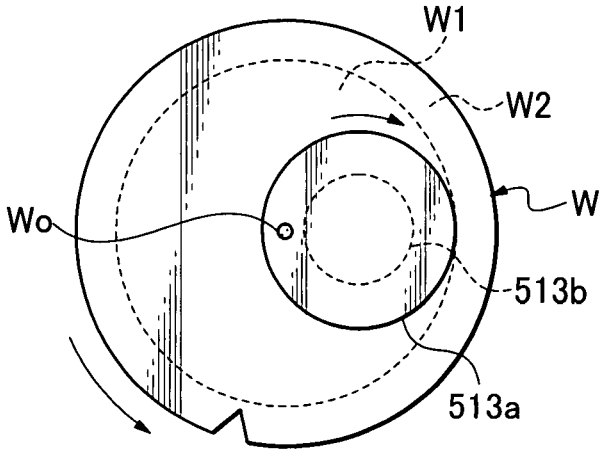
FIG. 9 is a view explaining the positional relationship between the path of rotation of the grindstone and the wafer being ground.

The grindstone 513 is rotated along a path defined by an outer circumference 513*a* having a diameter larger than the radius of the device region W1 and smaller than the diameter of the device region W1, as shown in FIG. 9. The wafer W has a center Wo of rotation, which is always inside of the outer circumference 513*a* of the area ground by rotation of the grindstone 513 and outside of its inner circumference 513*b*, so that the grindstone 513 may always be kept in contact with the wafer W at its center Wo of rotation. The grindstone is so controlled that the outer circumference 513*a* of its path of rotation does not contact the outer excess region W2 of the rear surface of the wafer.

Figure 10:
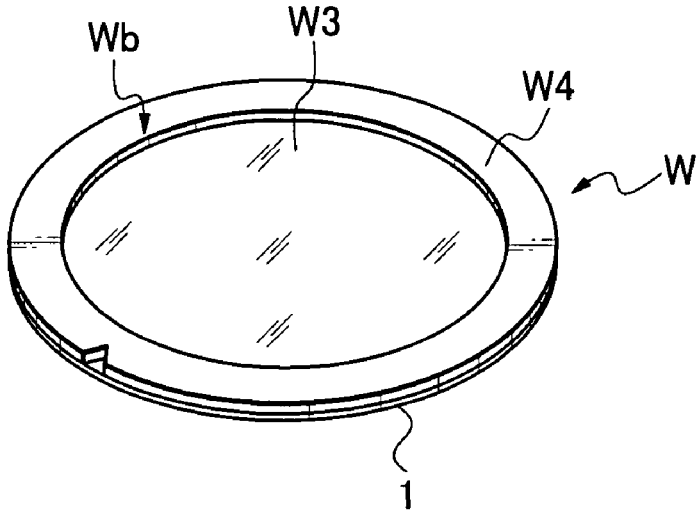
FIG. 10 is a perspective view of the wafer after being ground, with the unevenness absorbing pad bonded thereto.

As a result, the concavity W3 is formed in the rear surface Wb of the wafer at the area opposite from its device region W1 and is surrounded by the annular reinforcing portion W4 having the original thickness, as shown in FIG. 10. The wafer may have a thickness of, e.g. 30 μm at its concavity W3. The annular reinforcing portion W4 may have a thickness of, e.g. 700 μm.

The unevenness-absorbing pad 1 disposed between the chuck table 50 and the wafer W does not allow any pressure applied by the grindstone 513 to the wafer W to transfer any unevenness of its front surface Wa to its rear surface Wb. Thus, its grinding can result in improved flatness of the rear surface of the wafer and its device region W1 will provide individual devices of improved die strength.

When the concavity W3 and the annular reinforcing portion W4 have been formed, the unevenness-absorbing pad 1 is removed. If the unevenness absorbing pad 1 has an adhesive layer 4*b* only at the portion corresponding to the outer excess region W2 of the wafer as shown in FIG. 6, its removal does not allow any part of the adhesive layer to be left behind in the device region W1 of the wafer, and therefore would lower the quality of any of the individual devices may not lower.

Figure 11:
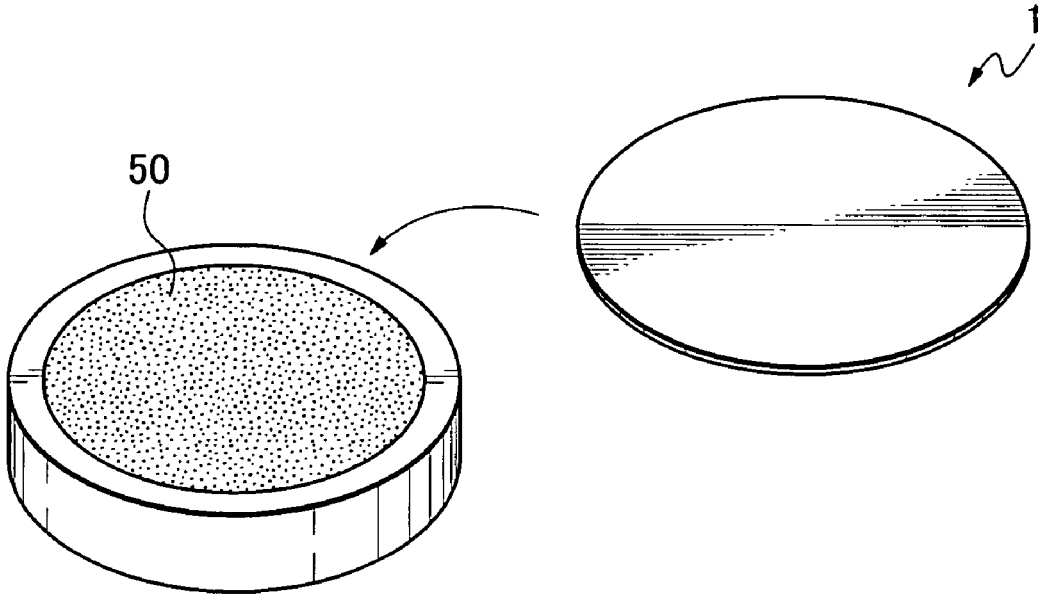
FIG. 11 is a cross sectional view of a third example of unevenness absorbing pad.

Although the unevenness-absorbing pad 1 has been described as being adhesively bonded to the wafer W, it is alternatively possible to place an unevenness-absorbing pad 1 on the chuck table 20 and place a wafer W thereon with its rear surface Wb exposed as shown in FIG. 11. In this case, if used a unevenness absorbing pad composed solely of a porous resin sheet, the unevenness absorbing pad 1 is not required to have any adhesive layer, since a force of suction acting on the chuck table 20 is transmitted to the surface Wa of the wafer W through a multiplicity of pores formed in the unevenness absorbing pad 1 and holds the wafer W in position.

What is claimed is:

1. A method for grinding a wafer to form a concave on a rear surface thereof, the wafer having on its front surface a device region defining a plurality of devices therein and an outer excess region surrounding the device region, by employing a grinding apparatus including a chuck table for holding the wafer rotatably and a grinder having a rotatable grindstone, the method comprising:

disposing an unevenness absorbing pad between the chuck table and the device region of the wafer for absorbing unevenness of the device region, and causing the wafer held by the chuck table to be rotated and ground, while keeping the grindstone in contact with the rear surface of the wafer at a center of rotation of the wafer, and while keeping the grindstone out of contact with a portion of the rear surface opposite from the outer excess region, thereby forming a concavity in a portion of the rear surface of the wafer opposite from the device region, and forming an annular reinforcing portion including the portion of the rear surface opposite from the outer excess region and around the concavity.

2. A method according to claim 1, wherein the unevenness absorbing pad has a porous resin sheet.

3. A method according to claim 2, wherein the porous resin sheet is made of polyethylene.

4. A method according to claim 3, wherein the unevenness-absorbing pad rests on the chuck table and the wafer rests on the unevenness-absorbing pad.

5. A method according to claim 2, wherein the unevenness-absorbing pad further includes a non-porous sheet laminated on the porous resin sheet.

6. A method according to claim 2, wherein the unevenness-absorbing pad rests on the chuck table and the wafer rests on the unevenness-absorbing pad.

7. A method according to claim 1, wherein the unevenness absorbing pad has an adhesive layer formed on one surface thereof for bonding it to the wafer.

8. A method according to claim 7, wherein the adhesive layer is formed only in a portion of the unevenness absorbing pad corresponding to the outer excess region of the wafer.

9. A method according to claim 1, wherein the unevenness-absorbing pad rests on the chuck table and the wafer rests on the unevenness-absorbing pad.

* * * * *